US008413553B2

(12) United States Patent
Chen

(10) Patent No.: US 8,413,553 B2
(45) Date of Patent: Apr. 9, 2013

(54) PIVOT HEAD WRENCH

(75) Inventor: Tai-Hung Chen, Chang Hua Hsien (TW)

(73) Assignee: Infar Industrial Co., Ltd, Chang Hua Hsien (TW)

( * ) Notice: Subject to any disclaimer, the term of this patent is extended or adjusted under 35 U.S.C. 154(b) by 308 days.

(21) Appl. No.: 12/983,181

(22) Filed: Dec. 31, 2010

(65) Prior Publication Data

US 2012/0167727 A1 Jul. 5, 2012

(51) Int. Cl.
*B25B 23/16* (2006.01)

(52) U.S. Cl.
USPC ..... 81/177.9; 81/177.8; 81/60

(58) Field of Classification Search ..... 81/177.7–177.9, 81/60–63.2
See application file for complete search history.

(56) References Cited

U.S. PATENT DOCUMENTS 7,509,893 B2 3/2009 Wu
8,245,604 B2 * 8/2012 Chen ..... 81/177.8
2005/0268753 A1 * 12/2005 Lin ..... 81/177.9

* cited by examiner

*Primary Examiner* — Monica Carter
*Assistant Examiner* — Melanie Alexander
(74) *Attorney, Agent, or Firm* — Pai Patent & Trademark Law Firm; Chao-Chang David Pai

(57) ABSTRACT

A pivot head wrench includes a handle, a switch, a pusher, a position-retaining device including a resilient member, a pawl, and a driving head. The pivot head wrench is switchable between lock and unlock modes. In the lock mode, the switch is rotated to a first position, and the pusher is abutted against the pawl, and the driving head is adapted to be pivoted at various positions, and the pawl is temporarily disengaged from the driving head when the driving head is pivoted from one position to another and engagement therebetween is resumed by the resilient member thereafter. In the unlock mode, the switch is rotated to a second position, and the switch is abutted against the pawl such that the pawl is restrained from movement and from disengagement from the driving head, and the driving head is restrained and securely held in place at a selected position.

9 Claims, 11 Drawing Sheets

PIVOT HEAD WRENCH

BACKGROUND OF THE INVENTION

1. Field of the Invention

The present invention relates to a pivot head wrench and, in particular, to a pivot head wrench switchable between a lock mode to restrain the head from being pivoted and an unlock mode to allow the head to be pivoted.

2. Description of the Related Art

U.S. Pat. No. 7,509,893 discloses a hand tool locking device for a hand tool includes a switch member including a shank rotatably inserted in a recess defined in a head of the hand tool, and the shank includes a convex and curved surface and a flat surface. Further, a pawl and a spring are received in a passage defined in the yoke of the head of the hand tool. The pawl includes a plurality of teeth defined on a first end thereof and is pushed to engage with the head such that the teeth thereof engaging with a plurality of engaging teeth defined on the tool head when the convex and curved surface of the shank pushes a second end of the pawl. Additionally, when the shank is rotated to make the flat surface contact the second end of the pawl, the teeth of the pawl are disengaged from the engaging teeth of the head. The drawback of the design is that the hand tool requires a retaining means to prevent the spring from disengagement from the pawl, and in addition, fatigue in the elasticity of the spring prohibits the pawl from retaining the head in a desired position precisely.

The present invention is, therefore, intended to obviate or at least alleviate the problems encountered in the prior art.

SUMMARY OF THE INVENTION

According to the present invention, a pivot head wrench includes a handle, a switch, a pusher, a position-retaining device, a pawl, and a driving head. The handle includes a receiving space, a bore extending therein and separated from the receiving space, a channel extending between and interconnecting the receiving space and the bore, and an aperture extending therein and from the bore and interconnected with the channel through the bore. The switch is engaged in the bore and is rotatable about a longitudinal axis and includes a first edge, a second edge, and a through orifice. The first and second edges are selectively disposed opposite to channel in which a first distance between the first edge and the channel is defined and a second distance between the second edge and the channel is defined respectively. The first distance is greater than the second distance. In addition, the through orifice extends through the switch as well as the first edge. The pusher is disposed and is movable in the through orifice. The position-retaining device is received in the aperture and includes a resilient member. The pawl is disposed and is movable in the channel and is selectively abutted against the pusher. The driving head is engaged with the handle and is pivotal at various positions with respect thereto and includes a driving end for engaging with an object to be driven by the pivot head wrench and a connecting end retained in the receiving space.

Furthermore, the pivot head wrench is switchable between a lock mode to restrain the driving head from being pivoted and an unlock mode to allow the driving head to be pivoted. In the lock mode, the switch is rotated to a first position such that the first edge is disposed opposite to channel, and the pusher is abutted against the pawl, and the driving head is adapted to be pivoted and is releasably positionable at various positions, and the pawl is temporarily disengaged from the driving head when the driving head is pivoted from one position to another position, and engagement of the pawl and the driving head is resumed by the resilient member after the driving head is moved to a selected position. In the unlock mode, the switch is rotated to a second position such that the second edge is disposed opposite to channel, and the second edge of the switch is abutted against the pawl such that the pawl is restrained from movement and from disengagement from the driving head, and the driving head is restrained and securely held in place at the selected position.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
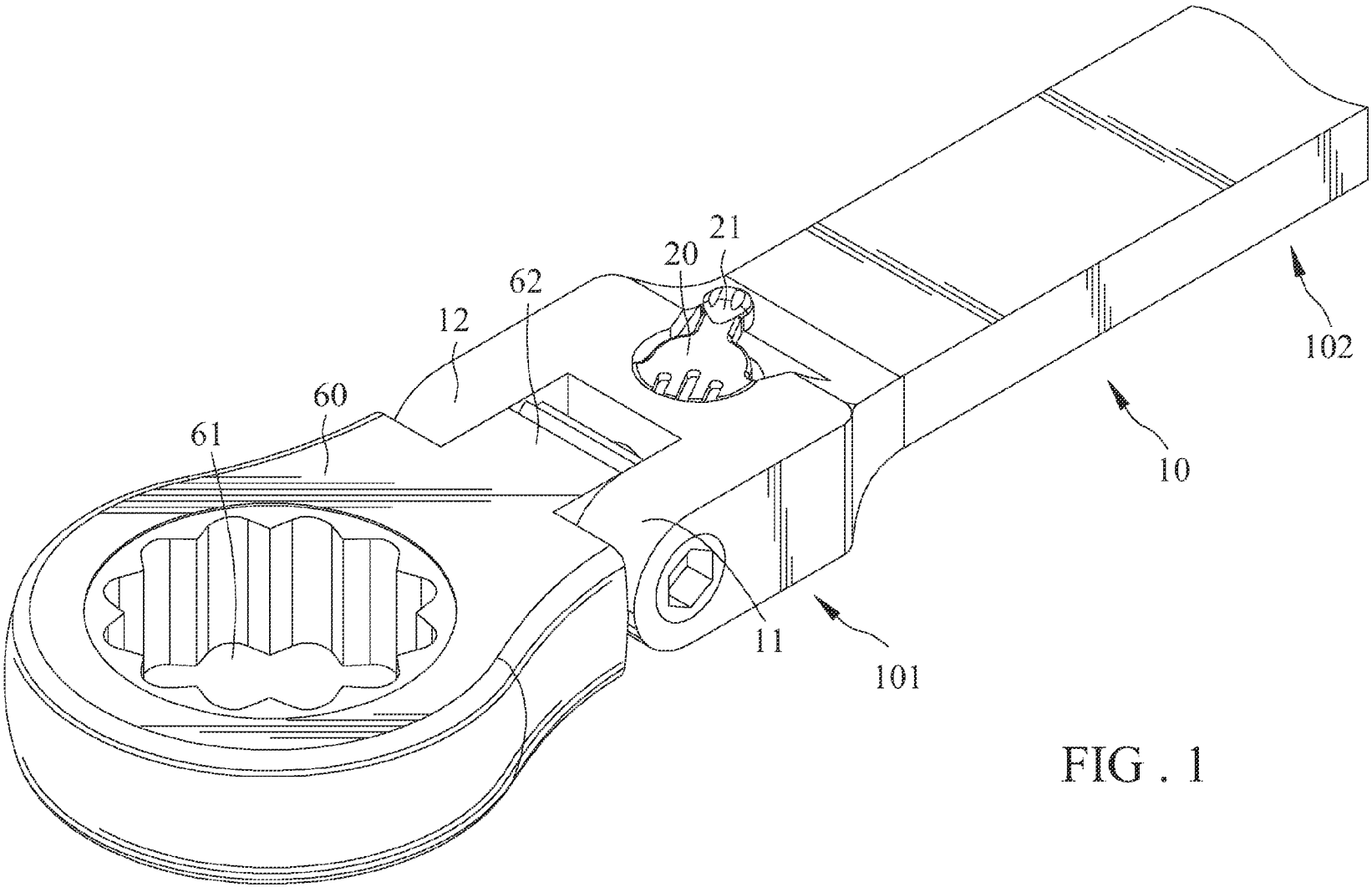
FIG. 1 is a perspective view of a pivot head wrench in accordance with the present invention.
Figure 2:
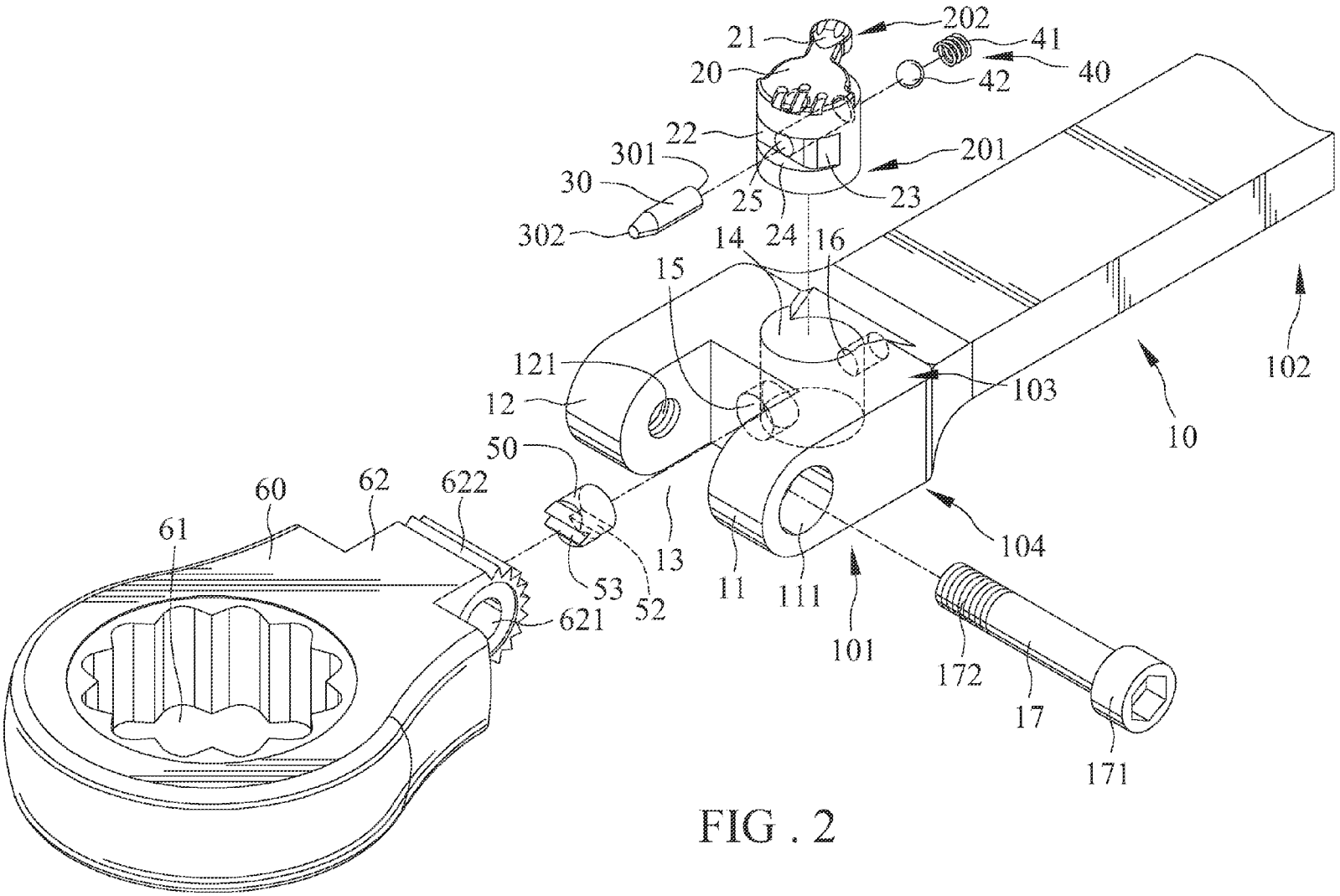
FIG. 2 is an exploded perspective view of the pivot head wrench of FIG. 1.
Figure 3:
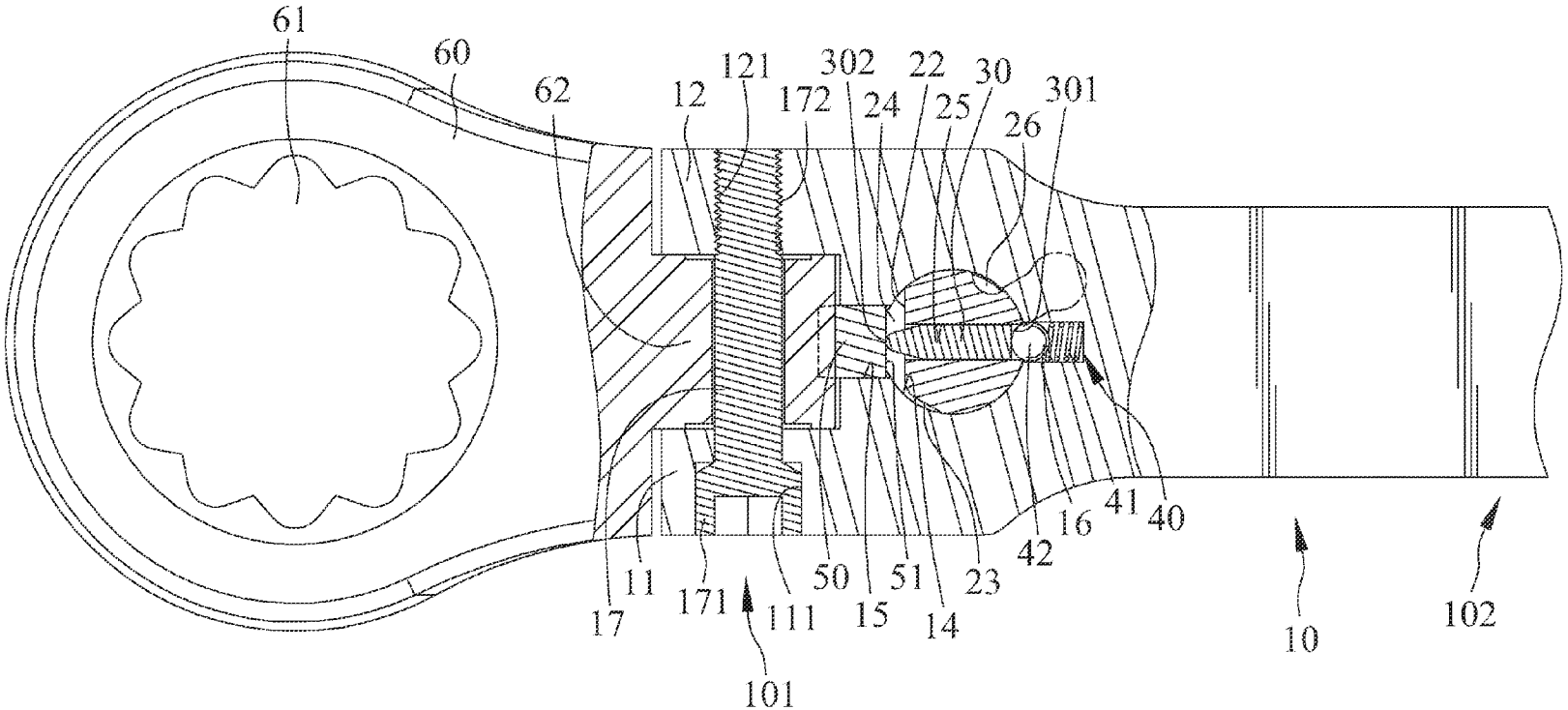
FIG. 3 is a cross-sectional view showing the pivot head wrench in a unlock mode in which a driving head of the pivot head wrench is adapted to be pivoted.
Figure 4:
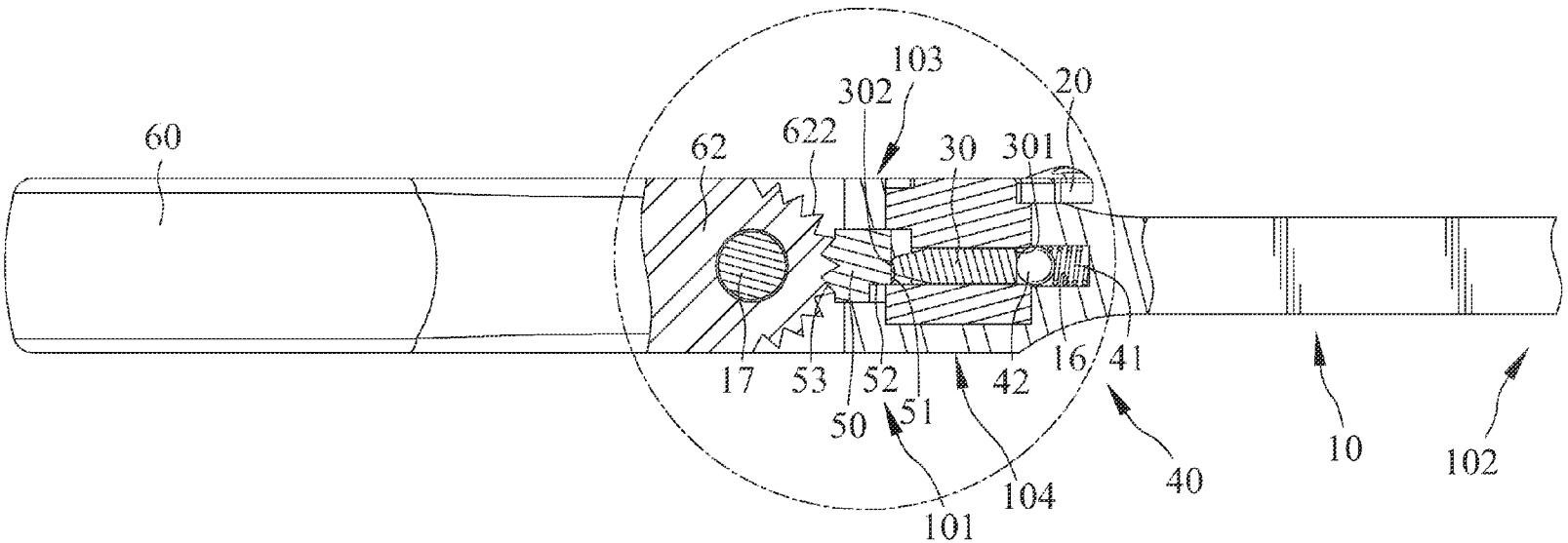
FIG. 4 is another cross-sectional view showing the pivot head wrench in the unlock mode.
Figure 5:
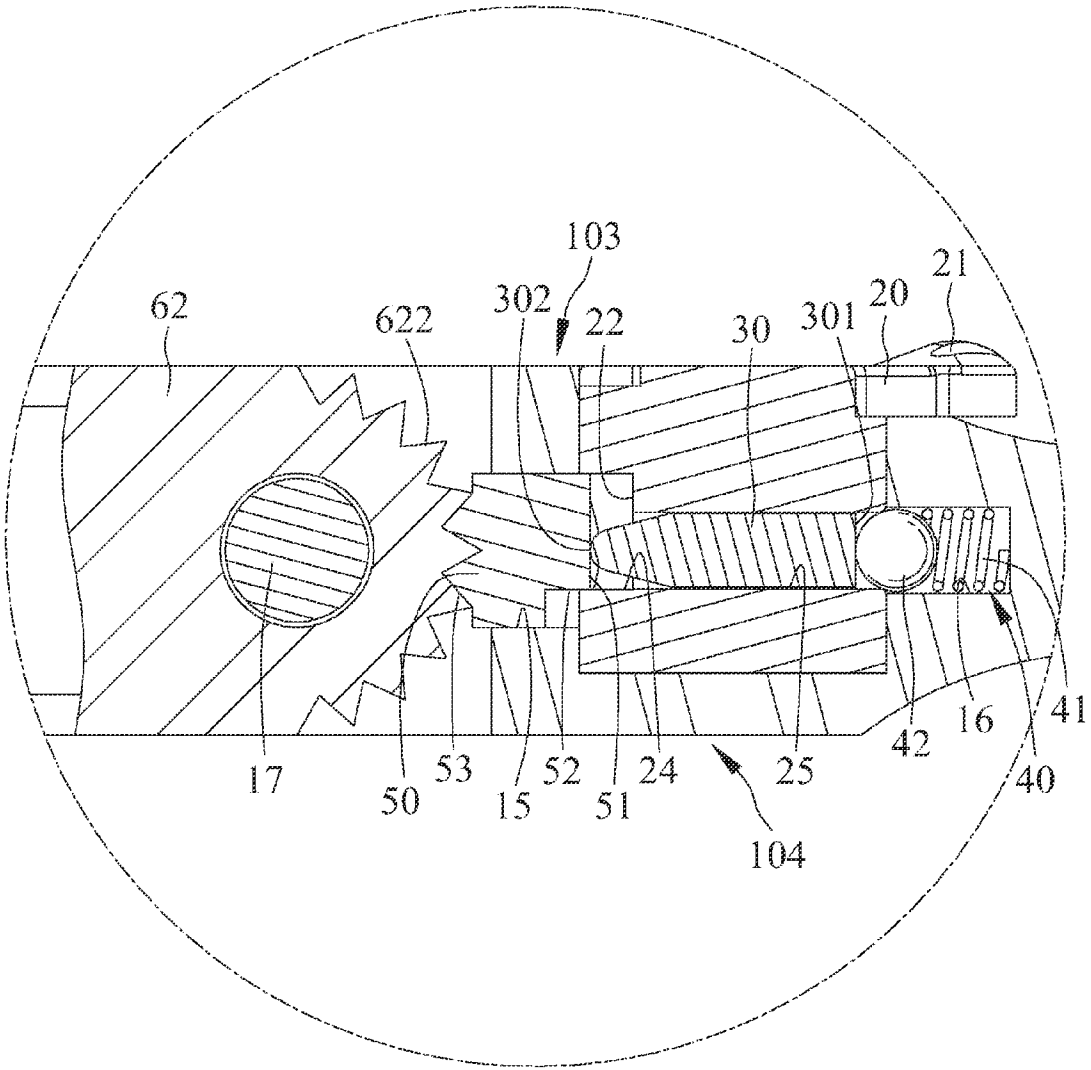
FIG. 5 is a partial, enlarged view of FIG. 4.
Figure 6:
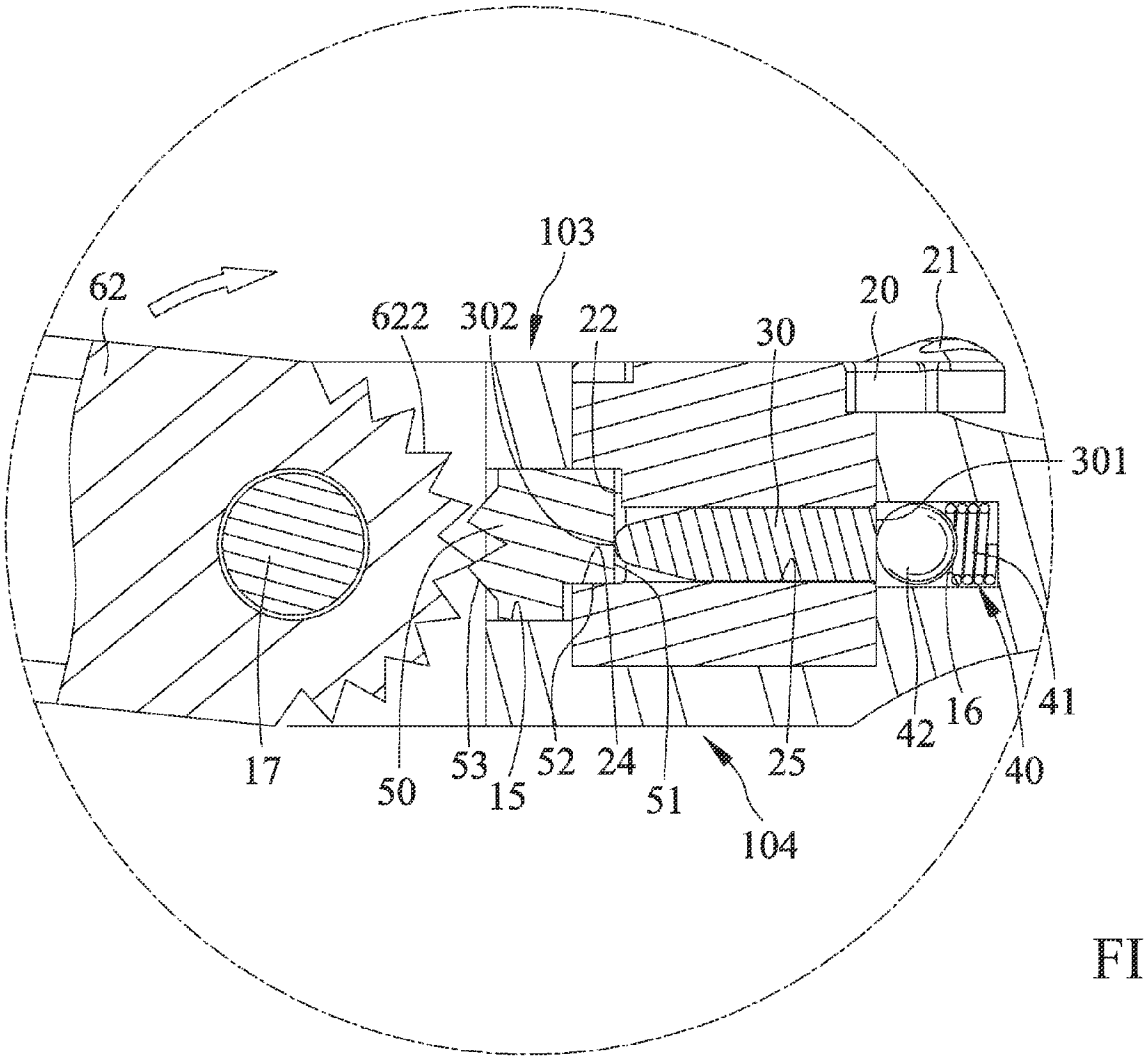
FIG. 6 is an extended cross-sectional view of FIG. 5 and shows the driving head in a temporary disengagement from a pawl engaged therewith upon pivoting of the driving head.
Figure 7:
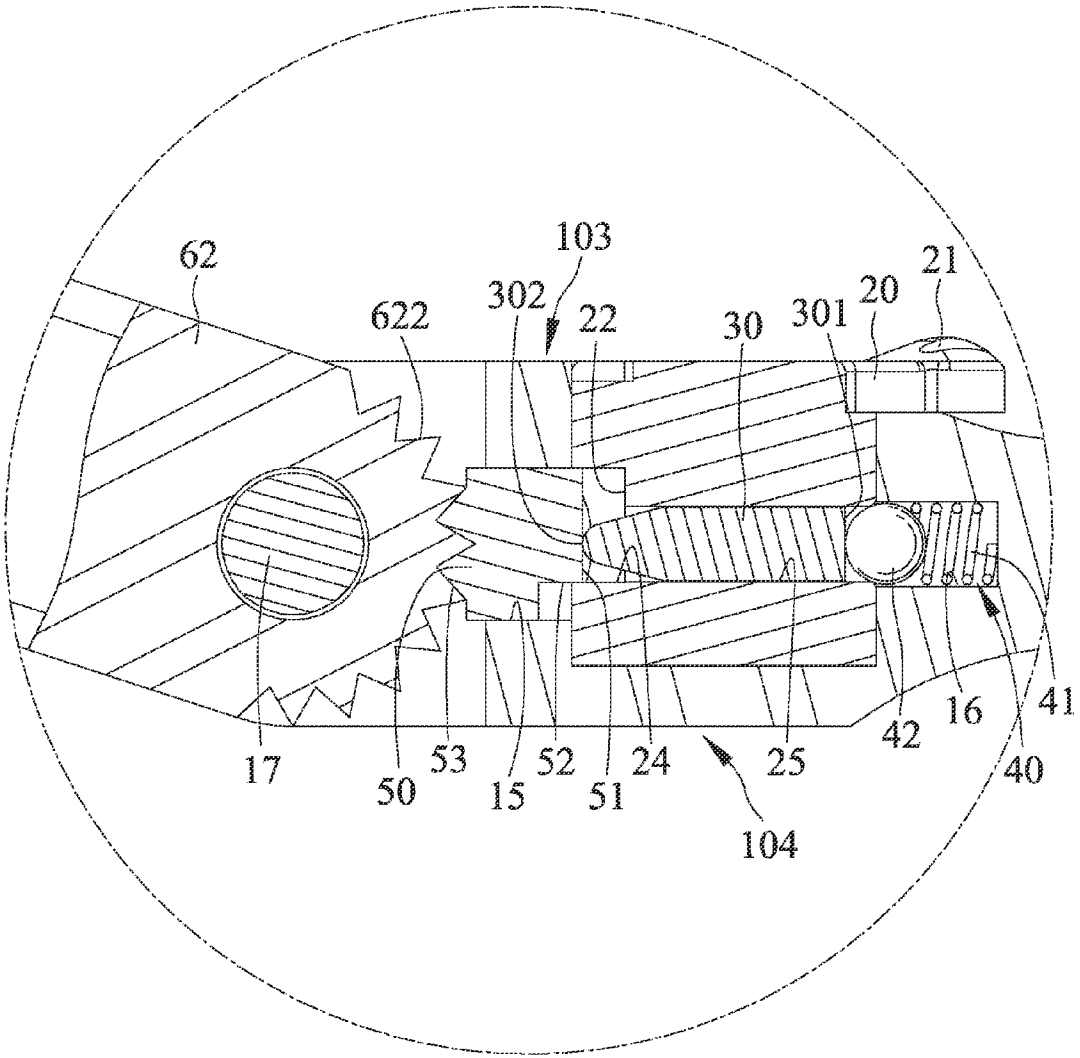
FIG. 7 is an extended cross-sectional view of FIG. 6 and shows the driving head in a position different from that of FIG. 5, as well as the driving head resuming engagement with the pawl.
Figure 8:
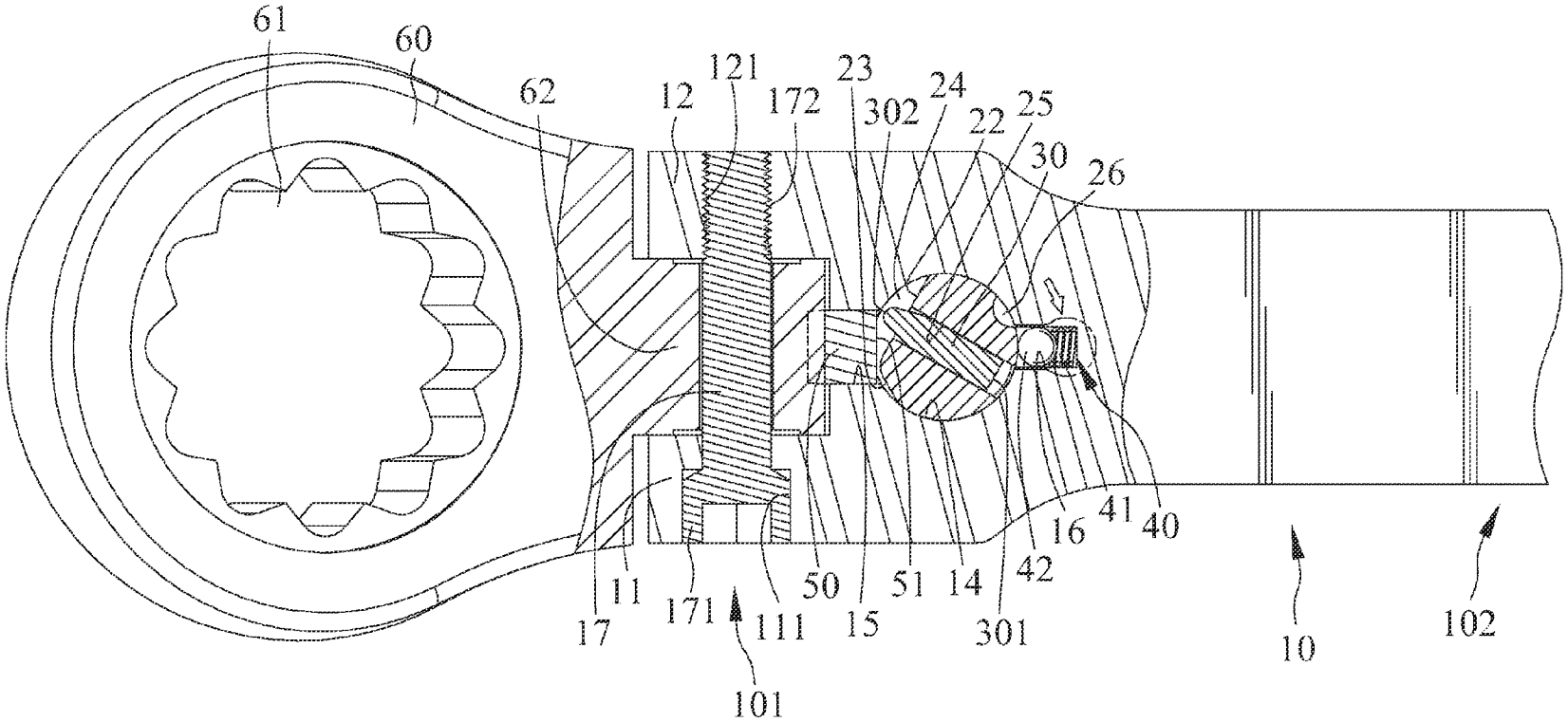
FIG. 8 is a cross-sectional view showing the pivot head wrench undergoing a mode change operation
Figure 9:
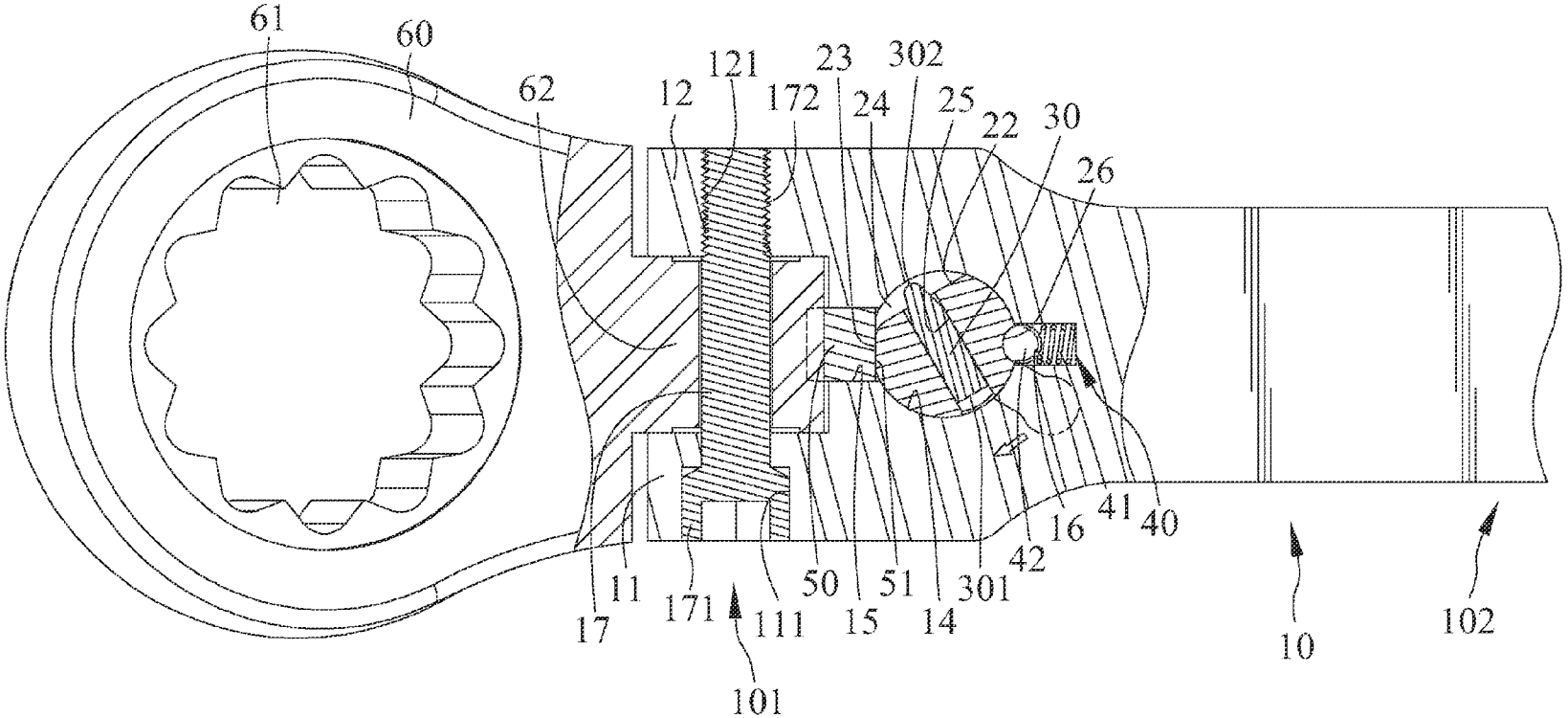
FIG. 9 is a cross-sectional view showing the pivot head wrench in a lock mode in which the driving head is restrained from being pivoted.
Figure 10:
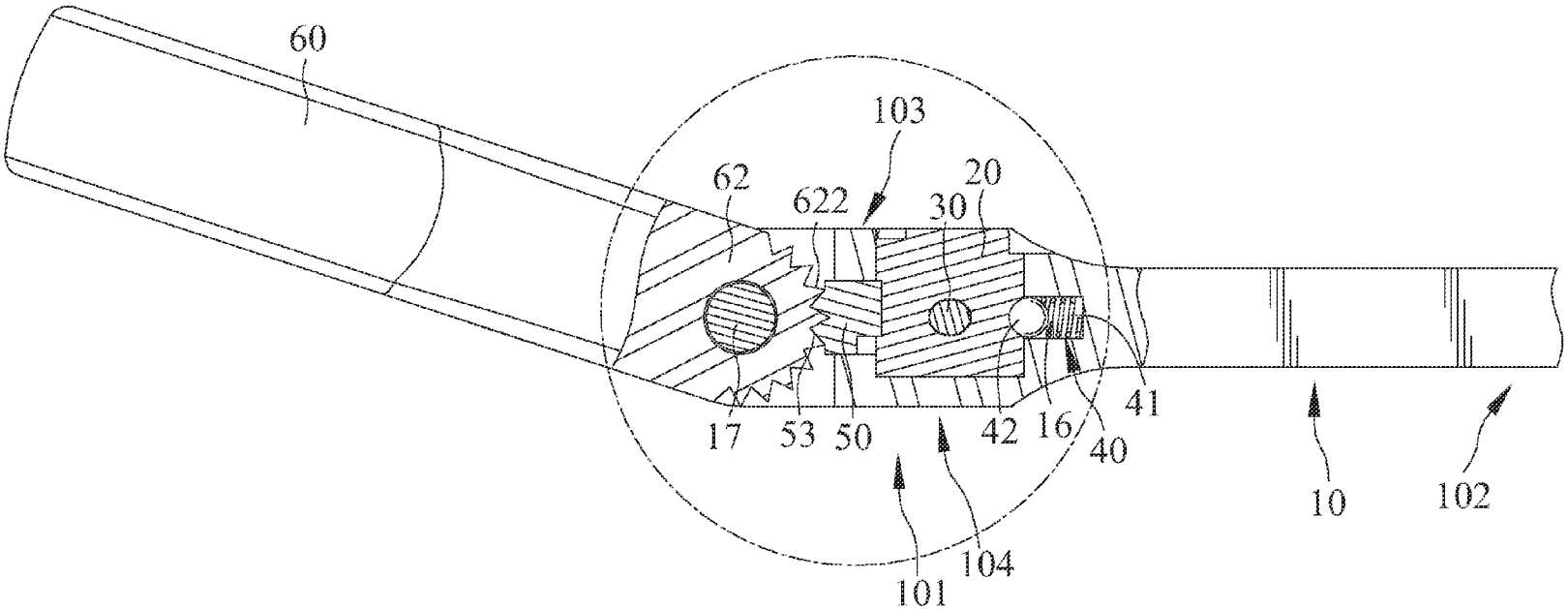
FIG. 10 is another cross-sectional view showing the pivot head wrench in the lock mode.
Figure 11:
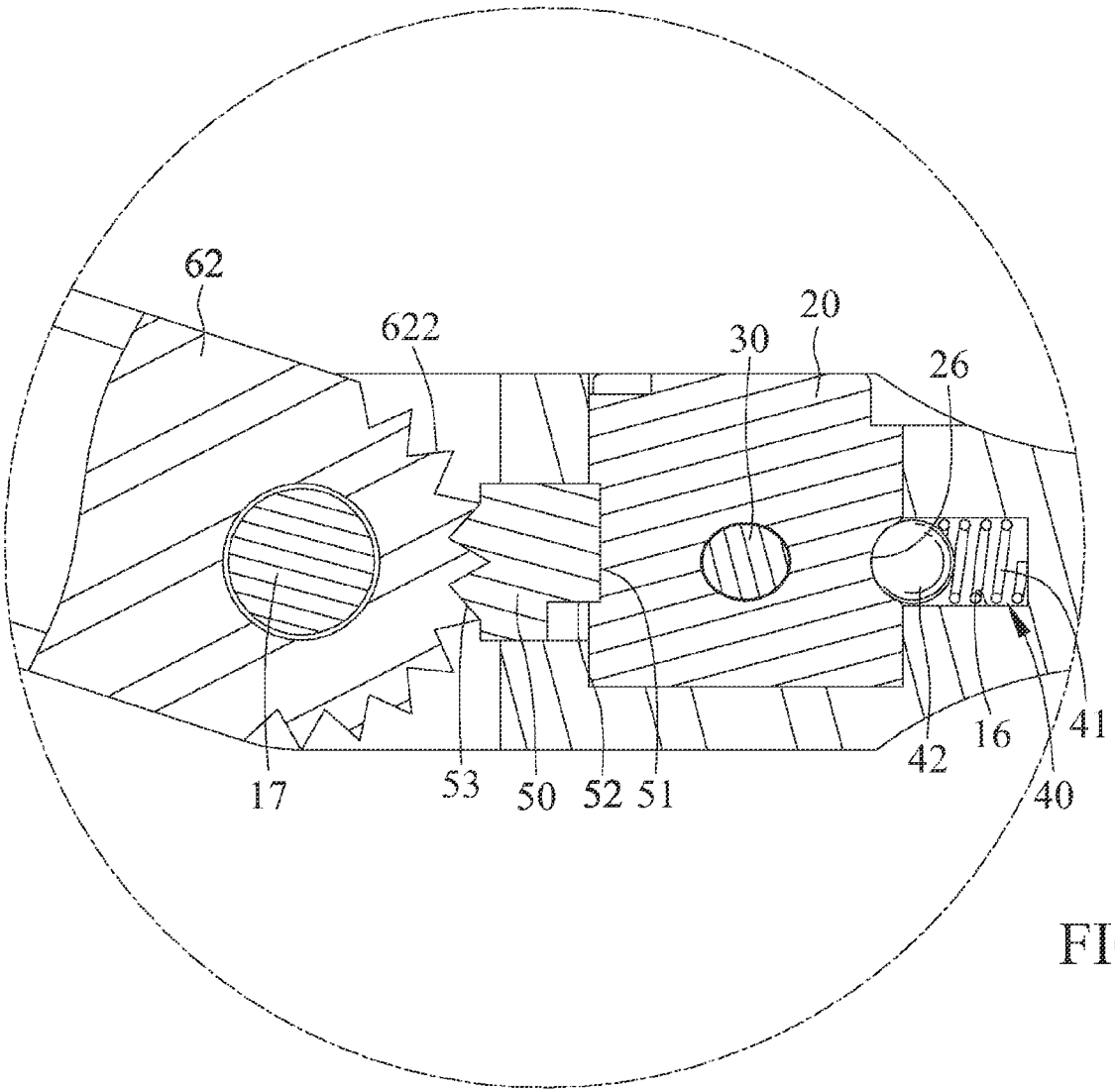
FIG. 11 is a partial, enlarged view of FIG. 10.

Referring to the drawings, a pivot head wrench in accordance with the present invention include a handle 10, a switch 20, a pusher 30, a position-retaining device 40, a pawl 50, and a driving head 60.

The handle 10 serves as a lever arm and is grasped by an operator during the operation of the pivot head wrench. Namely, the handle 10 includes two different ends defining a first end 101 and a second end 102, and the first end 101 engages with the driving head 60, and in addition, the second end 102 is where the operator grasps during the operation of the pivot head wrench. Moreover, the first end 101 of the handle 10 includes two surfaces defining a first surface 103 and a second surface 104 opposing to the first surface 103, first and second prongs 11 and 12 extending longitudinally in the same direction and disposed in a spaced relationship and between which a receiving space 13 is defined, a bore 14 extending therein and disposed behind and separated from the receiving space 13, a channel 15 extending between and interconnecting the receiving space 13 and the bore 14, and an aperture 16 extending therein and from the bore 14 and is interconnected with the channel 15 through the bore 14. Further, a fastener 17 secures the driving head 60 to the first end 101 of the handle 10, that is, the first and second prongs 11 and 12 includes a through hole 111 and an orifice 121, respectively, and the driving head 60 includes a driving end 61 for engaging with an object to be driven by the pivot head wrench and a connecting end 62 opposite to the driving end 61 as well as disposed in the receiving space 13 including a hole 621 therethrough, and the fastener 17 is inserted through the through hole 111 and the hole 621 and is engaged in the orifice 121, and in addition, the fastener 171 includes two distal ends defining a first distal end 171 and a second distal end 172, and the first distal end 171 is adapted to be engaged with a tool that facilitates installation of the fastener 17 and is disposed in the through hole 111, and the second distal end 172 is disposed in the orifice 121. In the preferred embodiment, the fastener 17 is in thread engagement with the orifice 121.

The switch 20 is engaged in the bore 14 and extends along a longitudinal axis and defines a longitudinal length between a first terminal end 201 and a second terminal end 202 thereof, and in addition, is rotatable in the bore 14 about the longitudinal axis. Moreover, the switch 20 includes a controlling section 21, a first edge 22, a second edge 23, a third edge 24, a through orifice 25, and a recess 26. The controlling section 21 extends from the second terminal end 202 and is exposed outside the bore 14 for facilitating the operation of the switch 20. The first, second and third edges 22, 23, and 24 are defined on an outer peripheral edge of the switch 20 and are cooperated together and are received in the bore 14, and in addition, the first and second edges 22 and 23 are connected together circumferentially and each has a height along the longitudinal axis of the switch 20 from a bottom side to a top side thereof, and the third edge 24 extends circumferentially from the first edge 22 to the second edge 23 and radially outwardly from the bottom sides of the first and second edges 22 and 23 to the outer peripheral edge of the switch 20. Likewise, the switch 20 is adapted to be rotated such that the first and second edges 22 and 23 selectively opposing to channel 15. In the preferred embodiment, the first and second edges 22 and 23 have the same height and the top sides thereof are aligned with each other as well as the bottom sides thereof are aligned with each other, and in addition, the first, second and third edges 22, 23 and 24 are flat surfaces. Further, a distance between the first edge 22 and the channel 15 when the first edge 22 is disposed opposite to the channel 15 is greater than a distance between the second edge 23 and the channel 15 when the second edge 23 is disposed opposite to the channel 15. The through orifice 25 extends through the switch 20 as well as the first edge 22. The recess 26 is defined on the outer peripheral edge of the switch 20 and is diametrically opposite to the second edge 23.

The pusher 30 extends along a longitudinal axis and defines a longitudinal length between a first terminal edge 301 and a second terminal edge 302 thereof, and in addition, is disposed and is movable in the through orifice 25. In the preferred embodiment, the first terminal edge 301 is a flat surface, and the second terminal edge 302 is a conical shape. The position-retaining device 40 includes a resilient member 41 and a detent 42. The resilient member 41 and the detent 42 are received in the aperture 16, and the detent 42 is selectively movable between a first position abutting against the first terminal edge 301 of the pusher 30 and a second position partially received in the recess 26. The pawl 50 is disposed and is movable in the channel 15. Moreover, the pawl 50 includes a first engaging edge 51 selectively abutting against the second terminal edge 302, a second engaging edge 52 movable relative to and adapted to abut against the third edge 24, and a third engaging edge 53 engaged at various positions with an engaging section 622 defined on the connecting end 62. Preferably, the third engaging edge 53 is defined by a plurality of teeth, and the engaging section 622 is defined by a plurality of teeth, and the teeth of the third engaging edge 53 are mutually engaged with some of the plurality of teeth of the engaging section 622.

The pivot head wrench is switchable between a lock mode to restrain the driving head 60 from being pivoted and an unlock mode to allow the driving head to be pivoted. In the lock mode, the switch 20 is rotated to a first position such that the first edge 22 is disposed opposite to channel 15, and the detent 42 is resiliently urged by the resilient member 41 and is disposed in the first position, and the second terminal edge 302 of the pusher 30 is abutted against the first engaging edge 51 of the pawl 50, and the driving head 60 is adapted to be pivoted and is releasably positionable at various positions. In addition, the third engaging edge 53 is temporarily disengaged from the engaging section 622 when the driving head 60 is pivoted from one position to another position, and engagement of the third engaging edge 53 and the engaging section 622 is resumed by resilient force of the resilient member 41 after the driving head 60 is moved to a selected position. In the lock mode, the switch 20 is rotated to a second position such that the second edge 23 is disposed opposite to channel 15, and the detent 42 is disposed in the second position, and the second edge 23 of the switch 20 is abutted against the first engaging edge 51 of the pawl 50 such that the pawl 50 is restrained from movement and from disengagement from the engaging section 622 of the driving head 60, and the driving head 60 is restrained and securely held in place at a selected position.

In view of the forgoing, the driving head 60 is therefore adapted to be precisely restrained at a selected position when the pivot head wrench is in the lock mode. Furthermore, the pivot head wrench is of a simple construction, and parts can be easily installed.

While the specific embodiment has been illustrated and described, numerous modifications come to mind without significantly departing from the spirit of invention and the scope of invention is only limited by the scope of accompanying claims.

What is claimed is:

1. A pivot head wrench comprising:

a handle including a receiving space, a bore extending therein and separated from the receiving space, a channel extending between and interconnecting the receiving space and the bore, and an aperture extending therein and from the bore and interconnected with the channel through the bore;

a switch engaged in the bore and rotatable about a longitudinal axis and including a first edge, a second edge, and a through orifice, with the first and second edges selectively disposed opposite to channel in which a first distance between the first edge and the channel is defined and a second distance between the second edge and the channel is defined respectively, with the first distance greater than the second distance, with the through orifice extending through the switch as well as the first edge;

a pusher disposed and movable in the through orifice;

a position-retaining device received in the aperture and including a resilient member;

a pawl disposed and movable in the channel and selectively abutting against the pusher; and a driving head engaged with the handle and pivotal at various positions with respect thereto and including a driving end for engaging with an object to be driven by the pivot head wrench and a connecting end retained in the receiving space; and wherein the pivot head wrench is switchable between a lock mode to restrain the driving head from being pivoted and an unlock mode to allow the driving head to be pivoted; and wherein in the lock mode of the pivot head wrench, the switch is rotated to a first position such that the first edge is disposed opposite to channel, and the pusher is abutted against the pawl, and the driving head is adapted to be pivoted and is releasably positionable at various positions, and the pawl is temporarily disengaged from the driving head when the driving head is pivoted from one position to another position, and engagement of the pawl and the driving head is resumed by the resilient member after the driving head is moved to a selected position; and wherein in the unlock mode of the pivot head wrench, the switch is rotated to a second position such that the second edge is disposed opposite to channel, and the second edge of the switch is abutted against the pawl such that the pawl is restrained from movement and from disengagement from the driving head, and the driving head is restrained and securely held in place at the selected position.

2. The pivot head wrench as claimed in claim 1, wherein the switch includes a recess diametrically opposing to the second edge, and the position-retaining device includes a detent biased by the resilient member and selectively movable between a position abutting against the pusher when the switch is disposed in the first position and another position partially received in the recess when the switch is disposed in the second position, respectively.

3. The pivot head wrench as claimed in claim 1, wherein the first and second edges are connected together circumferentially and each has a height along the longitudinal axis of the switch from a bottom side to a top side thereof.

4. The pivot head wrench as claimed in claim 3, wherein the first and second edges have the same height and the top sides thereof are aligned with each other as well as the bottom sides thereof are aligned with each other.

5. The pivot head wrench as claimed in claim 3, wherein the first and second edges are flat surfaces.

6. The pivot head wrench as claimed in claim 3, wherein the switch includes a third edge extending circumferentially from the first edge to the second edge and radially from the first and second edges, and the pawl is movable relative to and abutted against the third edge.

7. The pivot head wrench as claimed in claim 6, wherein the third edge is a flat surface.

8. The pivot head wrench as claimed in claim 1, wherein the pawl includes a third engaging edge engaged at various positions with an engaging section defined on the connecting end.

9. The pivot head wrench as claimed in claim 8, wherein the third engaging edge is defined by a plurality of teeth, and the engaging section is defined by a plurality of teeth, and the teeth of the third engaging edge are mutually engaged with some of the plurality of teeth of the engaging section.

* * * * *